US005989645A

United States Patent [19]

Flores

[11] Patent Number: 5,989,645

[45] Date of Patent: Nov. 23, 1999

[54] METHOD AND APPARATUS FOR OPERATING A SYSTEM FOR GALVANIZING STEEL SHEET

[75] Inventor: Roberto Robles Flores, Nuevo Leon, Mexico

[73] Assignee: Galvak, S.A. de C.V., San Nicolas de los Garza, Mexico

[21] Appl. No.: 09/038,262

[22] Filed: Mar. 10, 1998

Related U.S. Application Data

[60] Provisional application No. 60/040,239, Mar. 10, 1997.

[51] Int. Cl.[6] ..... B05D 1/18

[52] U.S. Cl. ..... 427/433; 427/436

[58] Field of Search ..... 427/433, 431, 427/436, 405, 406; 118/429

[56] References Cited

U.S. PATENT DOCUMENTS

| | | | |
|---|---|---|---|
| 3,383,189 | 5/1968 | Sendzimir | 427/433 |
| 4,741,384 | 5/1988 | Healey | 164/514 |
| 4,762,553 | 8/1988 | Savage et al. | 75/0.5 C |
| 5,354,970 | 10/1994 | Knupfer | 219/609 |

*Primary Examiner*—Shrive Beck
*Assistant Examiner*—Michael Barr
*Attorney, Agent, or Firm*—Frommer Lawrence & Haug LLP; A. Thomas S. Safford

[57] ABSTRACT

Method and apparatus for galvanizing steel sheet in a single galvanizing hot dip pot of the careless induction type, with great flexibility for frequent changes of galvanizing alloys, whereby the productivity of the single pot plant is increased and its investment costs are considerably lowered, in contrast with the current practice of operating plants with two continuously heated galvanizing pots, one in operation and one in stand-by. The single pot having a plurality of associated ingot molds of a capacity to hold a full charge of the alloy being discharged from the pot and a pumping system to empty a molten charge of one alloy composition from the pot into at least some of the stand-by ingot molds (ready for re-use later) and a transport system for replacing the removed charge by an alternate charge in the form of solid ingots of a different alloy composition (which can be either recycled ingots formed from a molten charge previously removed from the pot and/or fresh ingots). Part of any charge can first pass through a pre-melter. The pot preferably also has a heated cover to prevent thermal shock during the charging and discharging of the pot.

8 Claims, 1 Drawing Sheet

METHOD AND APPARATUS FOR OPERATING A SYSTEM FOR GALVANIZING STEEL SHEET

RELATED APPLICATION

This application, with a supplemented disclosure, claims the benefit of U.S. Provisional Application Ser. No. 60/040,239, filed Mar. 10, 1997.

FIELD OF THE INVENTION

The present invention relates to an improved method and apparatus for operating a system of production of galvanized steel sheet. More particularly, the invention refers to a method and apparatus for galvanizing steel sheet in a single galvanizing hot dip pot of the coreless induction type, with high flexibility for frequent changes of galvanizing alloys, whereby the productivity of the single pot plant is increased and its investment costs are considerably lowered, in contrast with the current practice of operating plants with two galvanizing pots, one in operation and one in stand-by.

BACKGROUND OF THE INVENTION

Galvanizing of continuous steel sheet is normally carried out by dipping said steel sheet in a bath of liquid metal, usually zinc, aluminum or mixtures thereof along with other additives, in order to form a thin coating of metal on said sheet.

Galvanizing plants usually process continuous steel sheet which is uncoiled at one end of the plant and is cleaned, prepared and dipped in the hot liquid coating metal, cooled down and recoiled at the other end of the plant. All of the equipment and process is designed and operated so that the quality of the surface of said sheet is optimal and with the aim of processing great lengths of steel sheet without interruption.

Most of the galvanizing plants, currently under operation, use two channel type electric induction pots to hold a bath of hot liquid coating metal (zinc or aluminum based coatings), one of the pots in operation and the other in stand-by position. These types of induction pots cannot be frequently emptied and refilled, because as a result of their design the induction coils would be damaged and lost. Consequently, they are always kept hot filled with liquid metal, consuming electricity during the stand-by periods in the order of 8,400 kwh per day for a pot with a capacity of about 100 metric tons. The continuous heating of both pots can last for a number of years. The common practice is to carry out monthly production runs to produce coated sheet with two different alloys according to the production schedule. Duration of each run per alloy varies normally between about 5 and 15 days. Some plants also have a pre-melt furnace, of the gas fired type or of the electric induction type for melting solid ingots of zinc to fill the operating pots. Another variation of the prior art (with off-set melting by coreless induction furnaces) is shown in U.S. Pat. No. 5,354,970 (which is incorporated herein by reference). The flexibility of the current galvanizing plants for carrying out short runs or frequently changing the metal coating is very limited and the two-pot arrangement is expensive (both in duplicative capital cost and in added standby heating costs). In order to change the coating composition, the operating pot is moved to the stand-by position and the other pot is moved to the operating position. Another alternative is to move the strip being immersed into the operating pot to a second position where it is immersed in the other pot. If three or more different coatings are desired, the practice of the prior art to have one separate pot for each different coating composition is not practical and would be very expensive.

The present invention overcomes the disadvantages of the prior art and uses a single dip pot of the coreless type, which is also capable of melting solid metal ingots and of forming the required galvanizing liquid bath rapidly without the necessity of maintaining a second galvanizing pot in stand-by (with the consequent expense of electric energy and the other financial costs of a second pot). If more than three different coating compositions are desired, this invention provides a way of having solid ingots of each desired coating ready to be used, while in the prior art practice only two different compositions at a time were contemplated.

OBJECTS AND SUMMARY OF THE INVENTION

It is therefore an object of the invention to provide a process of galvanizing steel sheet in a system for switching back and forth between at least two different galvanizing coating sources but using only a single hot-dip galvanizing pot of the coreless electric induction type.

It is another object of the invention to provide a method of galvanizing steel sheet in a system having lower investment and operational costs with high flexibility for alternating the composition of the galvanizing coatings, which can be easily extended to three or more coatings.

It is a also another object of the invention to provide an apparatus for galvanizing steel sheet in a system having lower investment and operational costs with high flexibility for changing back and forth between two (or even more) different compositions of galvanizing coatings.

Other objects of the invention will be in part obvious and in part pointed out hereinafter.

According to the present invention the objects thereof are achieved by providing a method of operating a system for galvanizing steel sheet having a single hot-dip galvanizing pot incorporating a coreless electric induction heater and giving an improved flexibility for low-cost alternating between applications of two or more different galvanizing coating compositions (sometimes referred to as "coatants") without the need for a duplicate stand-by galvanizing pot for each such alternate composition to be held at the ready in the molten state; comprising making successive runs of steel-sheet under controlled conditions through a molten bath of galvanizing coating composition in said pot, between at least some of such runs changing the coating composition of the molten bath by emptying said pot and transferring the molten contents of the pot into ingot molds for solidification to be available for future recycling to the bath, then selectively retrieving solid ingots of a replacement galvanizing coating composition different from that composition last removed from the pot with at least some of such replacement ingots having been both previously cast in at least some of such molds and having been derived from a molten bath of such different replacement galvanizing coating composition used previously in the single galvanizing pot, and then ultimately introducing the composition from such replacement ingots back into the emptied single galvanizing pot to form therein a subsequent renewed separate molten bath of such different replacement galvanizing coating composition; preferably melting all or most of the replacement ingots directly in said single galvanizing pot; and operating said system with the replacement molten bath until yet a new coating composition is desired; whereby the investment and operational costs are lowered as compared with those of galvanizing systems with two galvanizing pots.

The objects of the invention are also achieved by providing an apparatus for galvanizing steel sheet with an improved flexibility having the capacity for low-cost alternating between applications of two or more different galvanizing coating compositions without the need for a duplicate stand-by galvanizing pot for each such alternate composition to be held at the ready in the molten state; comprising a single hot-dip galvanizing pot having a coreless electric induction heater, a plurality of ingot molds, a pump system capable of emptying said galvanizing pot by transferring molten galvanizing coating of one composition therefrom into any one or more of such ingot molds, a transport system capable of selectively retrieving solid ingots of a different galvanizing coating composition with at least some of such ingots being both previously cast in at least some of such molds and being derived from a bath of such different galvanizing coating composition used previously in the single galvanizing pot and ultimately re-introducing the composition of such ingots back into the emptied single galvanizing pot to form a subsequent renewed separate molten bath of such different galvanizing coating composition; whereby the apparatus of this invention is simpler and has lower investment and operational costs as compared to those of galvanizing systems with two galvanizing pots.

BRIEF DESCRIPTION OF THE DRAWINGS

In this specification and in the accompanying drawings, some preferred embodiments of the invention are shown and described and various alternatives and modifications thereof have been suggested; but it is to be understood that these changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION OF A PREFERRED EMBODIMENT OF THE INVENTION

Figure 1:
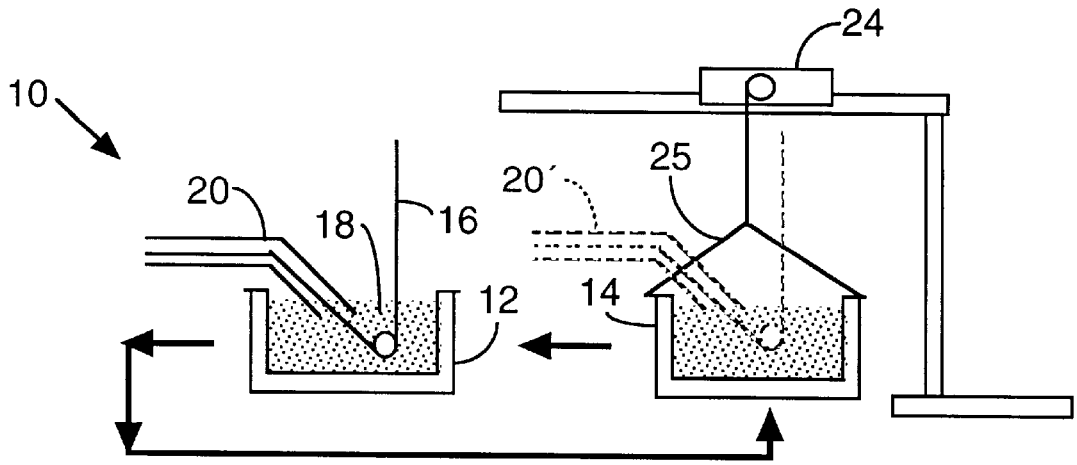
FIG. 1 shows a schematic diagram of a prior art galvanizing system as is typically currently operated.

Referring now to the drawings, in FIG. 1 numeral 10 generally designates a typical prior art galvanizing system having two galvanizing pots (usually of the channel induction type, although some installation exist using the coreless electric induction type). Pot 12 is in the operating position, and pot 14 is in the stand-by position. Steel sheet 16 is passed through the bath of molten coating 18 of a first composition, for coating its surface with the metallic coating. A protective channel 20 is usually provided for the treated steel sheet before its immersion in the molten bath. When a different coating composition is desired, the operating pot 12 is moved away and replaced by the stand-by pot 14 having the coating of the desired composition. These maneuvers require handling by heavy equipment 24 (pot 14 being shown suspended from an overhead crane by a cable 25), which result in substantial lost production time (because of the difficulty in handling the combined weight of the pots and molten bath). The costs of installations, moving equipment, maintenance, operation, etc. are high. An alternative used by the prior art to moving the galvanizing pots is moving the position of the channel and its associated equipment with the steel sheet 16 from the operating pot 12 to the location of the stand-by pot 14 (with the channel being indicated in dotted lines by the numeral 20').

Figure 2:
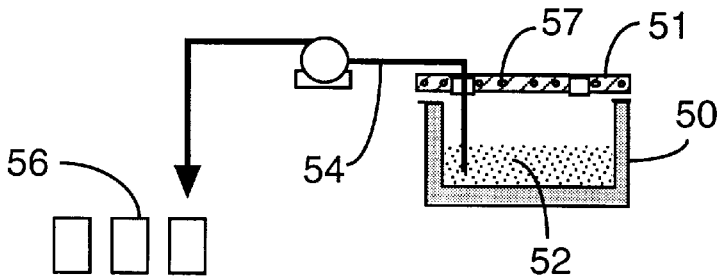
FIG. 2 is a schematic diagram of one of the method steps for changing the molten coating in a single hot-dip galvanizing pot (by pumping the molten coating composition from the pot into casting/holding molds).
Figure 3:
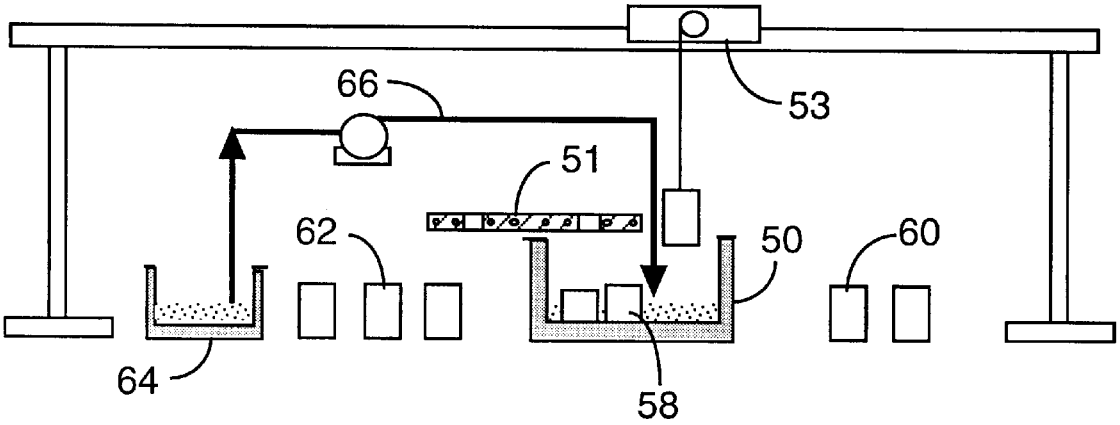
FIG. 3 is a schematic diagram of another of the method steps for changing the molten coating in a single hot-dip galvanizing pot (showing the various different coating composition ingots ready for use, with one set of ingots being melted in the pot).

The present invention offers a number of advantages by the surprisingly simple (but heretofore unobvious) alternative of operating the galvanizing system as illustrated in FIGS. 2 and 3. In order to change the composition of the molten coating, first the single galvanizing pot 50, having a bath of molten coating 52 of a first composition, is emptied by means of pumping and piping means 54, filling a plurality of molds 56 for storing said coating 52 for later use. An insulated cover 51 is preferably provided to cover pot 50 and to prevent rapid cooling of the refractory lining thereof which would cause damage from thermal shock while the pot is being emptied. Cover 51 may be moved by crane 53 and is optionally provided with heating means (electrical or gas burners 57) to maintain said pot at a predetermined temperature and avoid natural cooling thereof during the periods of time when the pot is being emptied or is melting ingots. As illustrated in FIG. 3, the coreless induction type pot 50, capable of melting solid ingots of coatings, is being fed by a crane transport system 53 with ingots 58 of the coating of a second composition. The ingots 58 are melted in the single pot 50, and the latter is then immediately put back in operation. Any one of a variety of different coatings can be stockpiled in the form of solid ingots, indicated with numerals 60 and 62, ready for prompt and convenient use. This flexibility is not feasibly possible in the prior art operating practices with baths of liquid coatings. If desired, for a more efficient start up of the melting operation, a pre-melter furnace 64, gas fired or powered by electricity, may be provided to the system for melting a suitable relatively smaller amount of the second coating. The crane 53 of the transport system feed the typically one ton ingots 58, 60 or 62 directly to the pot 50. If a pre-melter 64 is used, smaller 25 kilo ingots are feed to the pre-melter and the transport of such smaller melted ingots is completed by pump and piping 66.

Although the invention has been exemplified as applied to galvanizing of steel sheet and to the case of alternating between two different coating compositions, the invention is readily applicable to galvanizing of other types of metallic products and to the case of adding flexibility of alternating three or more different coating compositions. It is of course to be understood that the foregoing description is intended to be illustrative only and that numerous changes can be made in the structure of the system described and its operating conditions without departing from the spirit of the invention as defined in the appended claims.

What is claimed is:

1. A method of operating a system for galvanizing steel sheet having a single hot-dip galvanizing pot incorporating a coreless electric induction heater which method permits alternating between applications of two or more different galvanizing coating compositions without the need for a duplicate stand-by galvanizing pot for each such alternate composition to be held at the ready in the molten state; comprising making successive runs of steel-sheet under controlled conditions through a molten bath of galvanizing coating composition in said pot, between at least some of such runs changing the coating composition of the molten bath by emptying said pot and transferring the molten contents of the pot into ingot molds for solidification to be available for future recycling to the bath, then selectively retrieving solid ingots of a replacement galvanizing coating composition different from that composition last removed from the pot with at least some of such replacement ingots having been both previously cast in at least some of such molds and having been derived from a molten bath of such different replacement galvanizing coating composition used previously in the single galvanizing pot, and then ultimately introducing the composition from such replacement ingots back into the emptied single galvanizing pot to form therein a subsequent renewed separate molten bath of such different replacement galvanizing coating composition.

2. A method according to claim 1, further comprising pre-melting a relatively small amount of the total replacement ingots needed for forming a subsequent molten bath therefrom in a separate melting furnace and introducing said pre-melted composition into said emptied single galvanizing pot for facilitating the melting in the pot of the remaining replacement solid ingots needed for forming the subsequent molten bath.

3. A method according to claim 1, wherein at least some of the replacement ingots are make up ingots from a fresh source which have not been recycled from a prior molten bath in said pot.

4. A method according to claim 1, wherein at least the majority of the replacement ingots are directly melted in the pot.

5. A method according to claim 1, wherein all of the replacement ingots are directly melted in the pot.

6. A method according to claim 1, further comprising covering said single galvanizing pot with a lid to prevent thermal shock to the refractory lining of said pot while said pot is only partially filled with a molten bath including while such pot is being emptied and while ingots are being melted therein.

7. A method according to claim 6, further comprising using a heater located in said lid for at least aiding in maintaining the interior of said pot at a temperature effective to prevent thermal shock.

8. A method of operating a system for galvanizing steel sheet having a single hot-dip galvanizing pot incorporating a heater; comprising making successive runs of steel-sheet under controlled conditions through a molten bath of galvanizing coating composition in said pot, between at least some of such runs changing the coating composition of the molten bath by emptying said pot and transferring the molten contents of the pot into ingot molds for solidification to be available for future recycling to the bath, then selectively retrieving solid ingots of a replacement galvanizing coating composition different from that composition last removed from the pot with at least some of such replacement ingots having been both previously cast in at least some of such molds and having been derived from a molten bath of such different replacement galvanizing coating is composition used previously in the single galvanizing pot, and then ultimately introducing the composition from such replacement ingots back into the emptied single galvanizing pot to form therein a subsequent renewed separate molten bath of such different replacement galvanizing coating composition.

* * * * *